US011877685B2

(12) United States Patent
Chuang

(10) Patent No.: US 11,877,685 B2
(45) **Date of Patent: *Jan. 23, 2024**

(54) WINDOW SHADE

(71) Applicant: Shan-Chi Chuang, New Taipei (TW)

(72) Inventor: Shan-Chi Chuang, New Taipei (TW)

( * ) Notice: Subject to any disclaimer, the term of this patent is extended or adjusted under 35 U.S.C. 154(b) by 385 days.

This patent is subject to a terminal disclaimer.

(21) Appl. No.: 16/597,221

(22) Filed: Oct. 9, 2019

(65) Prior Publication Data

US 2021/0007528 A1 Jan. 14, 2021

(30) Foreign Application Priority Data

Jul. 11, 2019 (TW) ..... 108209065

(51) Int. Cl.
*A47H 23/01* (2006.01)
*A47H 13/00* (2006.01)

(52) U.S. Cl.
CPC ..... *A47H 23/01* (2013.01); *A47H 13/00* (2013.01)

(58) Field of Classification Search
CPC ..... A47H 1/04; A47H 13/00; A47H 13/01; A47H 23/00; A47H 23/01; A47H 2023/025; E06B 9/17046
See application file for complete search history.

(56) References Cited

U.S. PATENT DOCUMENTS 296,649 A * 4/1884 Tripp ..... A47H 23/01 160/393
303,332 A * 8/1884 Snell ..... A47H 23/01 160/349.1
1,436,209 A * 11/1922 Stegemeyer ..... A47H 23/01 160/393
1,757,017 A * 5/1930 Matovitz ..... A47H 23/01 160/392
1,766,905 A * 6/1930 Jackson ..... A47H 23/01 160/391
1,780,556 A * 11/1930 Kallin ..... E06B 9/42 160/394
1,780,913 A * 11/1930 Golden ..... E06B 9/42 160/387
1,782,905 A * 11/1930 Mohun ..... A47H 23/01 160/387
1,909,109 A * 5/1933 Kopfstein ..... E06B 9/42 160/384
1,934,103 A * 11/1933 Traut ..... E06B 9/17046 160/31

(Continued)

FOREIGN PATENT DOCUMENTS

FR 2350491 A * 1/1978

*Primary Examiner* — Johnnie A. Shablack
(74) *Attorney, Agent, or Firm* — Che-Yang Chen; Law Office of Michael Chen

(57) ABSTRACT

A window shade may include a shade, and each of a top portion and a bottom portion thereof has a mount bar. The shade is installed into a sliding unit through the mount bar on the top portion of the shade, and the mount bar on the bottom portion of the shade is coupled with a weight track. The mount bars on the top portion and the bottom portion of the shade are adapted to enable the shade to horizontally install on a top track of a window curtain and also to enable the weight of the weight track to be evenly distributed on the bottom portion of the shade, thereby smoothing the operation of the shade.

3 Claims, 6 Drawing Sheets

(56) References Cited

U.S. PATENT DOCUMENTS 2,255,581 A * 9/1941 Ewing ..... A47G 5/00 160/392
2,350,235 A * 5/1944 Johnson ..... E06B 9/42 160/387
2,350,236 A * 5/1944 Johnson ..... E06B 9/42 160/398
2,361,785 A * 10/1944 Mohun ..... E06B 9/42 160/238
2,466,648 A * 4/1949 Thexton ..... E06B 9/78 160/386
3,348,603 A * 10/1967 Ford ..... E06B 3/4609 160/197
3,524,491 A * 8/1970 Olson ..... A47H 23/01 160/393
3,911,991 A * 10/1975 Malferrari ..... A47H 23/00 160/202
4,357,978 A * 11/1982 Keller ..... E06B 9/17046 160/271
4,393,915 A * 7/1983 Olson ..... E06B 9/17046 160/384
4,525,946 A * 7/1985 Olson ..... E06B 9/60 160/298
5,109,910 A * 5/1992 Tortorella ..... A47H 15/04 160/197
5,657,808 A * 8/1997 Lin ..... A47H 13/00 160/330
5,862,851 A * 1/1999 Stoebich ..... E06B 9/56 160/121.1
6,357,507 B1 * 3/2002 Stoebich ..... A62C 2/10 160/121.1
6,802,357 B2 * 10/2004 Taylor ..... F16B 5/0028 160/371
6,892,783 B1 * 5/2005 Comeau ..... A47H 1/08 160/126
8,016,013 B2 * 9/2011 Horvath ..... E06B 9/54 160/23.1
8,695,193 B2 * 4/2014 Kress ..... A47H 99/00 29/414
9,115,533 B2 * 8/2015 Ng ..... E06B 9/42
9,458,665 B2 * 10/2016 Drifka ..... E06B 9/581
9,631,409 B2 * 4/2017 Wang ..... E05D 15/0639
9,976,346 B2 * 5/2018 Ng ..... E06B 9/42
D845,513 S * 4/2019 Bowman ..... D25/48.4
11,060,346 B2 * 7/2021 Chuang ..... A47H 1/04
2007/0215297 A1 * 9/2007 Lin ..... A47H 1/04 160/332
2009/0205791 A1 * 8/2009 Sans Folch ..... A47H 13/04 160/368.1
2012/0000617 A1 * 1/2012 Chu ..... E06B 9/24 160/349.1
2012/0061034 A1 * 3/2012 Ng ..... E06B 9/17046 160/290.1
2019/0100959 A1 * 4/2019 Chang ..... E06B 9/262
2019/0218857 A1 * 7/2019 Chuang ..... A47H 23/02
2021/0310299 A1 * 10/2021 Chiquin ..... E06B 9/42

* cited by examiner

WINDOW SHADE

FIELD OF THE INVENTION

The present invention relates to a window shade and more particularly to a reliable window shade that is easy to install.

BACKGROUND OF THE INVENTION

A conventional window shade is installed on a sliding unit through an upper end thereof, and the sliding unit is coupled in a top track of a window curtain. A lower end of the window shade has a weight block to stretch the window shade so as to make the window shade flat and not easy to be blown away by wind.

However, the conventional window curtain is disadvantageous because: the upper end and the lower end are folded and secured through stitching way to respectively form two locating portions, and the thickness of the locating portion is proportional to the length of the folded portion of the window shade. Nevertheless, the longer of the folded portion of the window shade leads to the increase of cost, and, on the contrary, when the thickness of the locating portion is too thin, the window shade may easily detach from the sliding unit or the weight block, resulting in inconvenience in use.

Moreover, when the window shade is larger, the folding way to form the locating portion may easily be folded unevenly, which may cause the sliding unit or the weight block cannot be mounted horizontally and the weight of the weight block cannot be evenly distributed on the lower end of the window shade so as to reduce the smoothness of opening and closing of the window shade and to make the window shade to be blown away from window by wind easily. Therefore, there remains a need for a new and improved design for a window curtain to overcome the problems presented above.

SUMMARY OF THE INVENTION

The present invention provides a window shade which comprises a shade, and each of a top portion and a bottom portion thereof has a mount bar. The mount bar is an elongated board body having a U-shaped cross section, and a connecting groove is formed inside the mount bar. The two mount bars are respectively coupled with the top portion and the bottom portion of the shade through the connecting grooves. The two mount bars are respectively secured on the top portion and the bottom portion of the shade through two stitching lines. The shade is installed into a sliding unit through the mount bar on the top portion of the shade, and the mount bar on the bottom portion of the shade is coupled with a weight track. The weight track is formed into a U-shaped, and a connecting space is formed inside the weight track, and two abutting portions are respectively formed at two lateral sides of the connecting space. Each of two top ends of the two abutting portions is bent inwardly into an inverted U-shape, and an inner leg of the inverted U is formed into a locating board, and each of the two locating boards is sloped from top to bottom to enable two ends of the two locating boards close to each other. Each of buffering spaces is formed between the locating board and the abutting portion so as to enable the abutting portion to slightly expand outwardly. The end of the locating board has a bent blocking portion. Each of two lateral ends of the weight track is coupled with a cover, and the inner diameter of the cover is smaller than the outer diameter of the weight track.

In one embodiment, each of two lateral ends of the mount bar has an inclined guiding edge.

In another embodiment, the weight track is made of iron.

Comparing with conventional window curtain, the present invention is advantageous because: (i) the mount bars on the top portion and the bottom portion of the shade are adapted to enable the shade to horizontally install on a top track of a window curtain and also to enable the weight of the weight track to be evenly distributed on the bottom portion of the shade, thereby smoothing the operation of the shade; (ii) each of the two lateral ends of the mount bar comprises one inclined guiding edge, which enables the shade to be installed easily; (iii) the mount bars on the top portion and the bottom portion of the shade can easily connect to the sliding unit and the weight track so that the consumers can easily install and replace different styles of shades by themselves with low costs; (iv) the weight track is made of iron, which is processed after been surface treatment, and the thickness and weight thereof can be customized according to the requirements so as to reduce structural cost and to ensure that the weight of the weight track is sufficient to prevent the shade from blown away by wind; (v) the weight track is coupled outside of the mount bar through the connecting space, and with the locating boards and the buffering spaces, when the covers are coupled on the two lateral ends of the weight track, the flexible abutting portions are stretched inwardly to enable the covers to sleeved thereon easily, and the abutting portions are stretched outwardly after the covers is sleeved on the weight track so as to secure the positions of the covers; and (vi) the blocking portions of the locating boards are adapted to couple on the shade to prevent the weight track from detached from the shade, which enables the window shade to be used safely.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
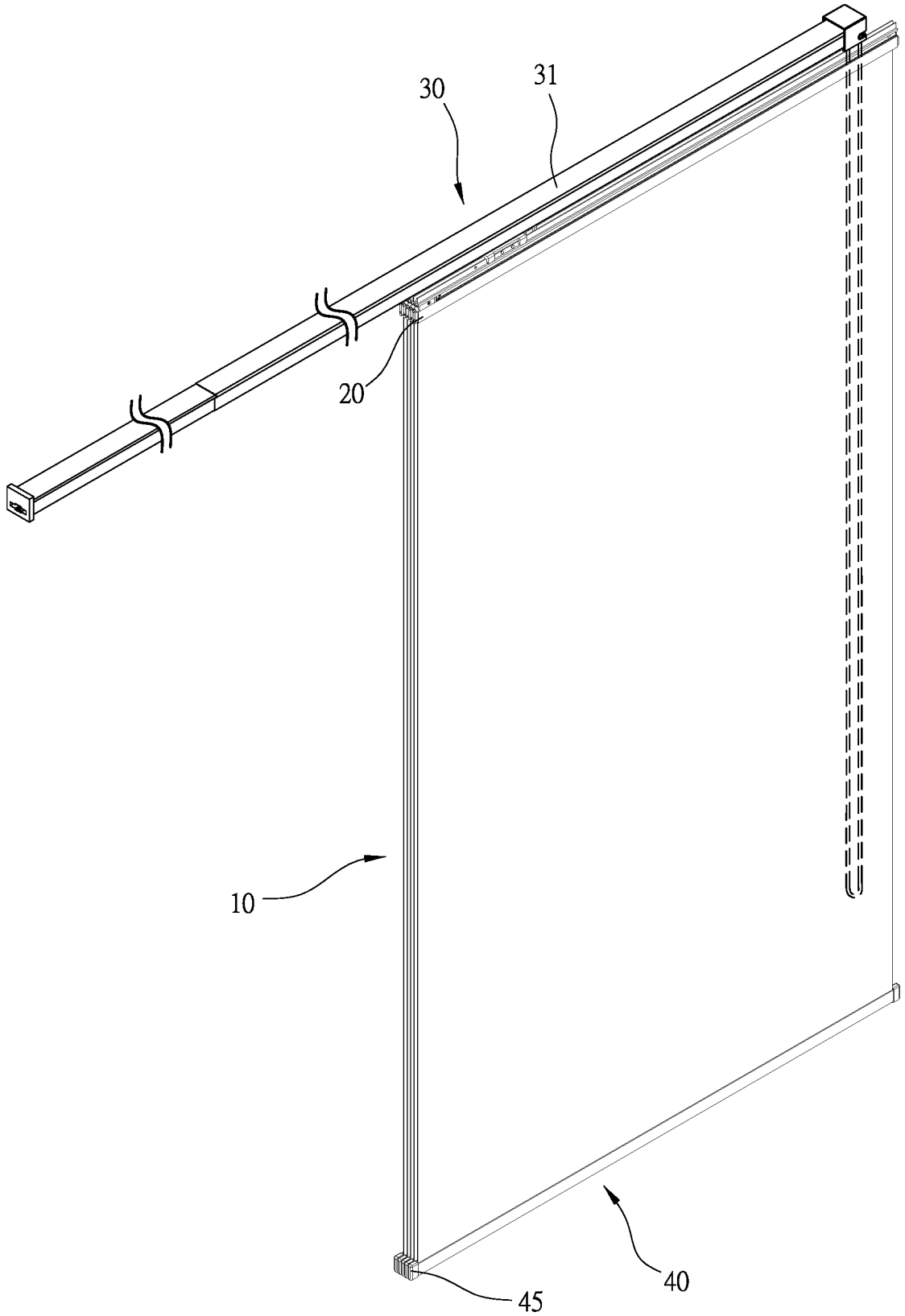
FIG. 1 is a three-dimensional assembly view of a window shade of the present invention.
Figure 2:
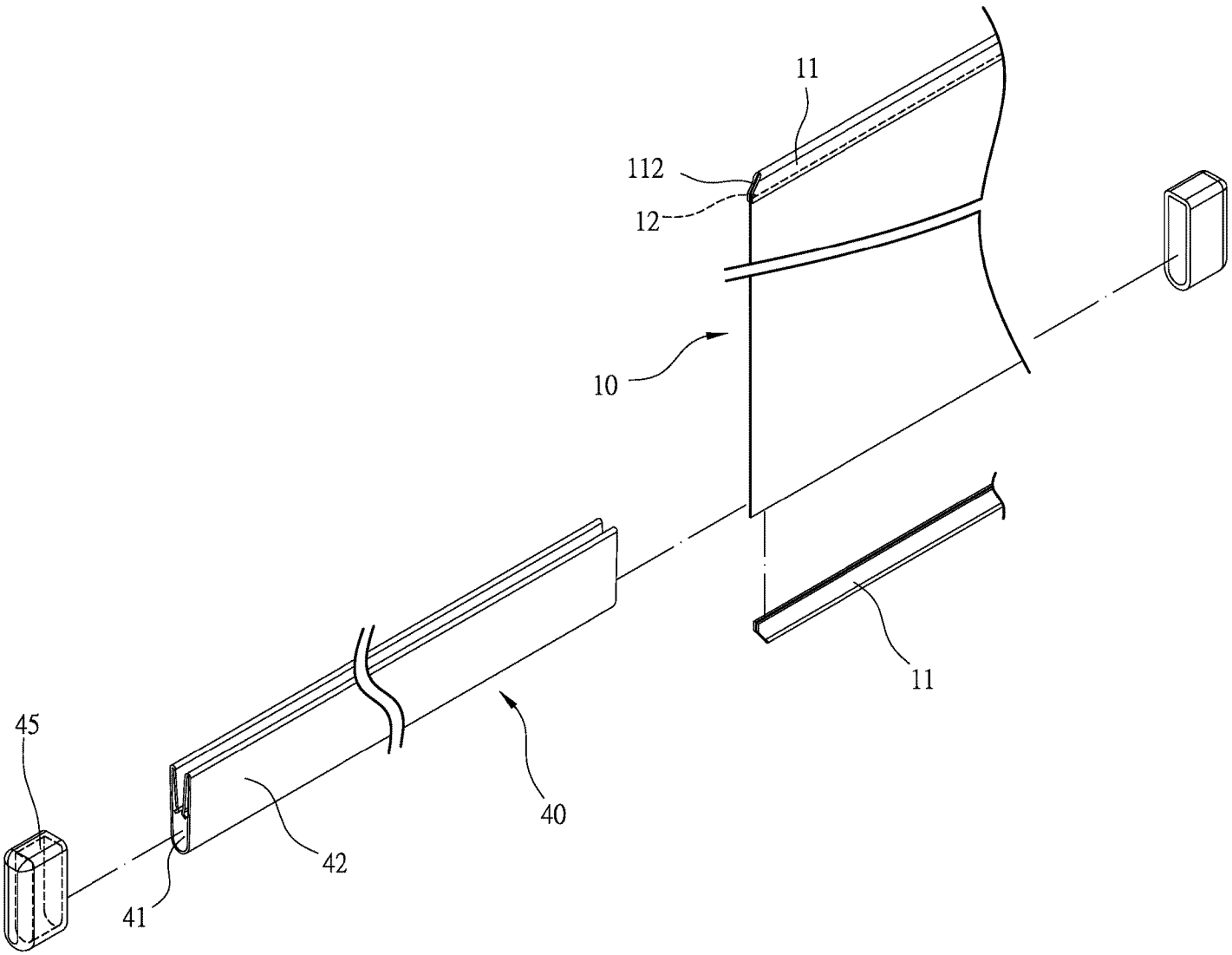
FIG. 2 is a three-dimensional exploded view of the window shade of the present invention.
Figure 4:
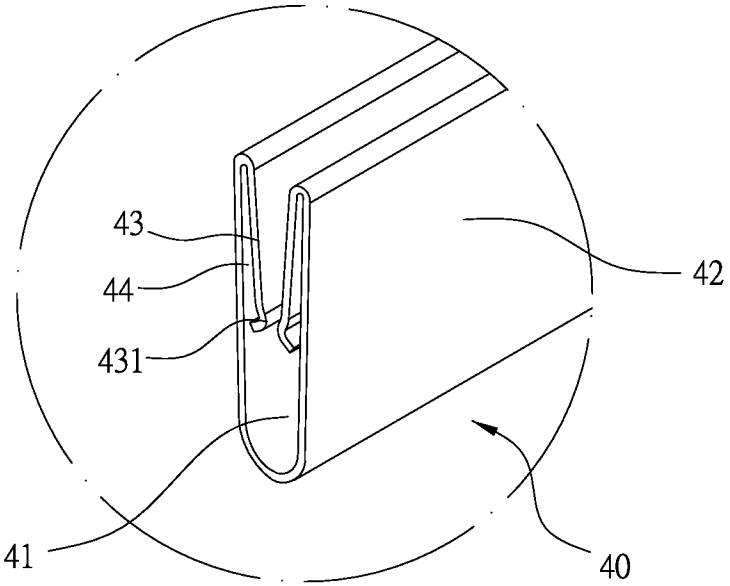
FIG. 4 is a partial enlarged view of a weight track of the window shade of the present invention.
Figure 3:
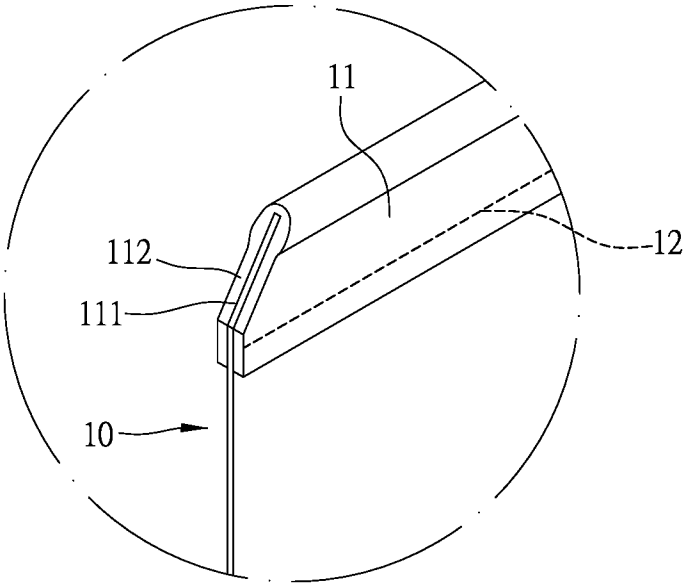
FIG. 3 is a partial enlarged view of the connection between a mount bar and a shade on a top portion of the shade in the present invention.
Figure 5:
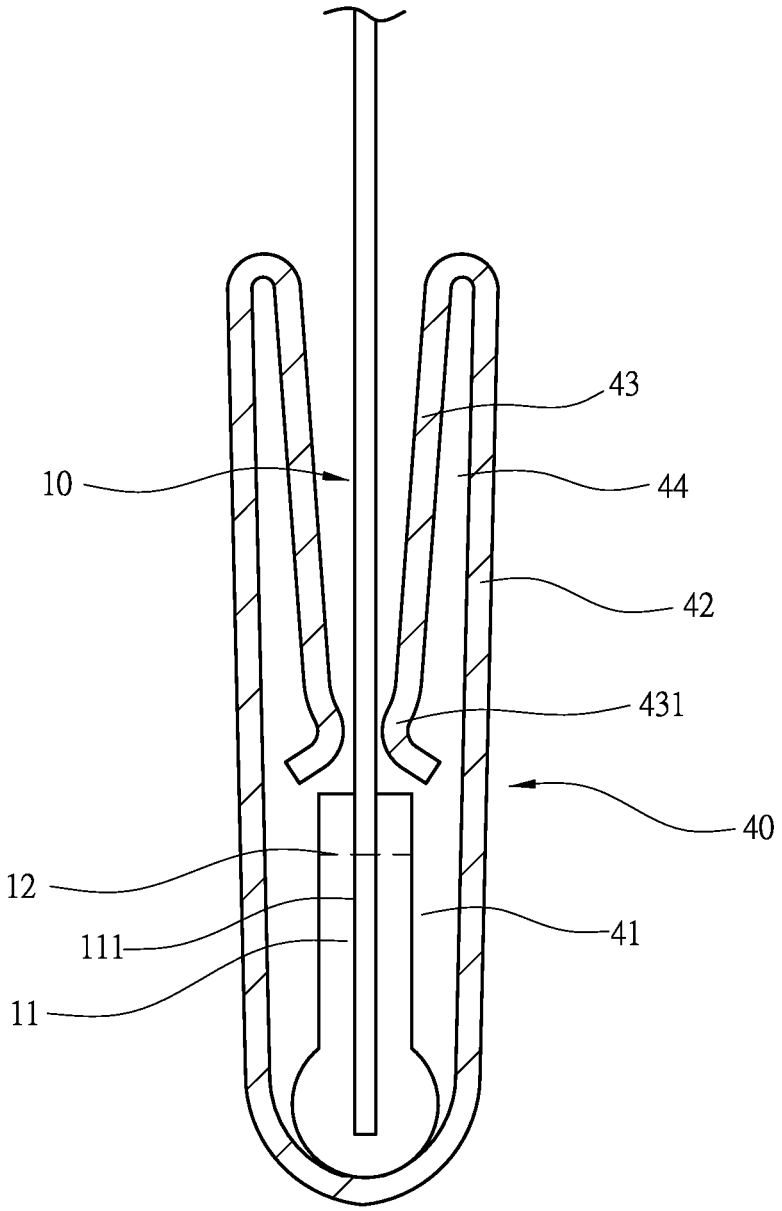
FIG. 5 is an exploded view illustrating the weight track is coupled on a bottom portion of the shade in the present invention.

In order to further understand the goal, characteristics and effect of the present invention, a number of embodiments along with the drawings are illustrated as following:

Referring to FIGS. 1 to 5, the present invention provides a window shade which comprises a shade (10), and each of a top portion and a bottom portion thereof has a mount bar (11). The mount bar (11) is an elongated board body having a U-shaped cross section, and a connecting groove (111) is formed inside the mount bar (11). Moreover, each of two lateral ends of the mount bar (11) has an inclined guiding edge (112), and the two mount bars (11) are respectively coupled with the top portion and the bottom portion of the shade (10) through the connecting grooves (111). The two mount bars (11) are respectively secured on the top portion and the bottom portion of the shade (10) through two stitching lines (12). The shade (10) is installed into a sliding unit (20) through the mount bar (11) on the top portion of the shade (10), and the sliding unit (20) is slidably installed on a top track (31) of a window curtain (30). The mount bar (11) on the bottom portion of the shade (10) is coupled with a U-shaped weight track (40) which is made of iron, and a connecting space (41) is formed inside the weight track (40), and two abutting portions (42) are respectively formed at two lateral sides of the connecting space (41). Each of two top ends of the two abutting portions (42) is bent inwardly into an inverted U-shape, and an inner leg of the inverted U is formed into a locating board (43), and each of the two locating boards (43) is sloped from top to bottom to enable two ends of the two locating boards (43) close to each other. Each of buffering spaces (44) is formed between the locating board (43) and the abutting portion (42) so as to enable the abutting portion (42) to slightly expand outwardly. Moreover, the end of the locating board (43) has a bent blocking portion (431). Each of two lateral ends of the weight track (40) is coupled with a cover (45), and the inner diameter of the cover (45) is smaller than the outer diameter of the weight track (40).

Figure 6:
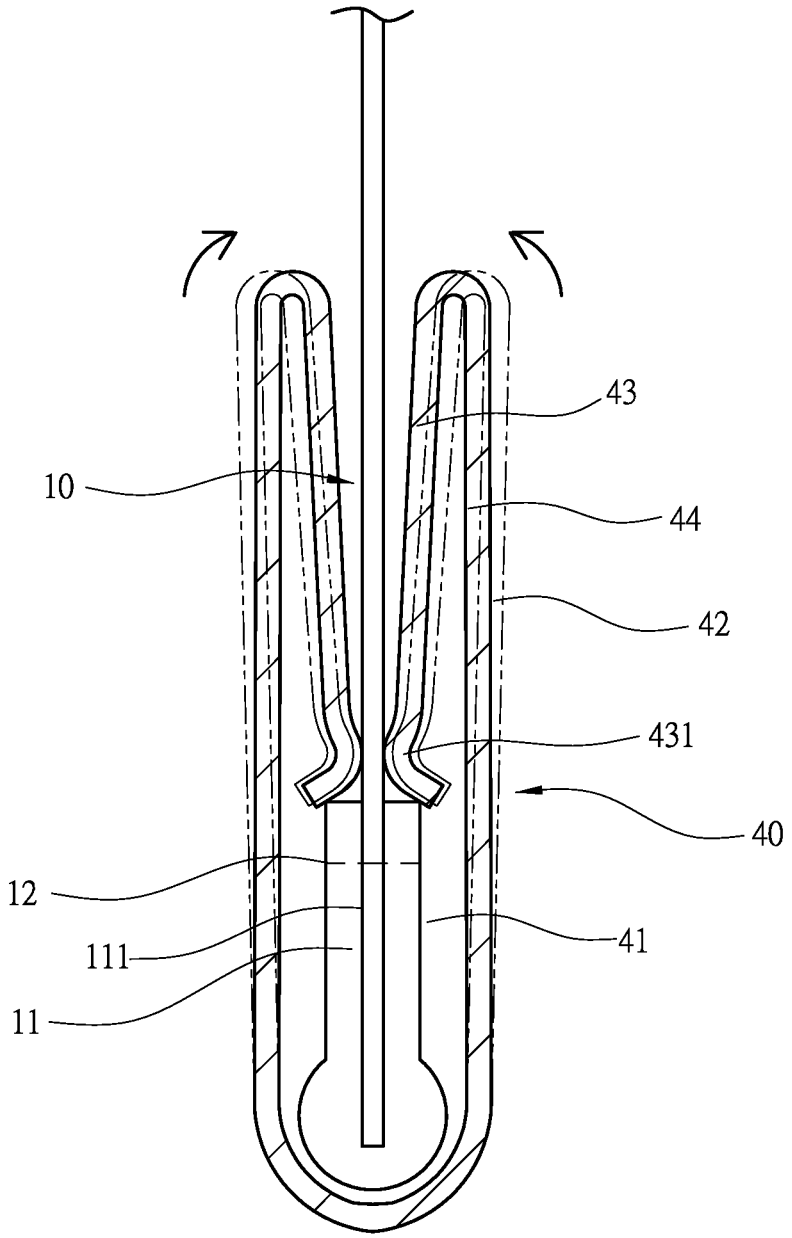
FIG. 6 is a sectional view illustrating the weight track is secured the shade in the present invention.
Figure 7:
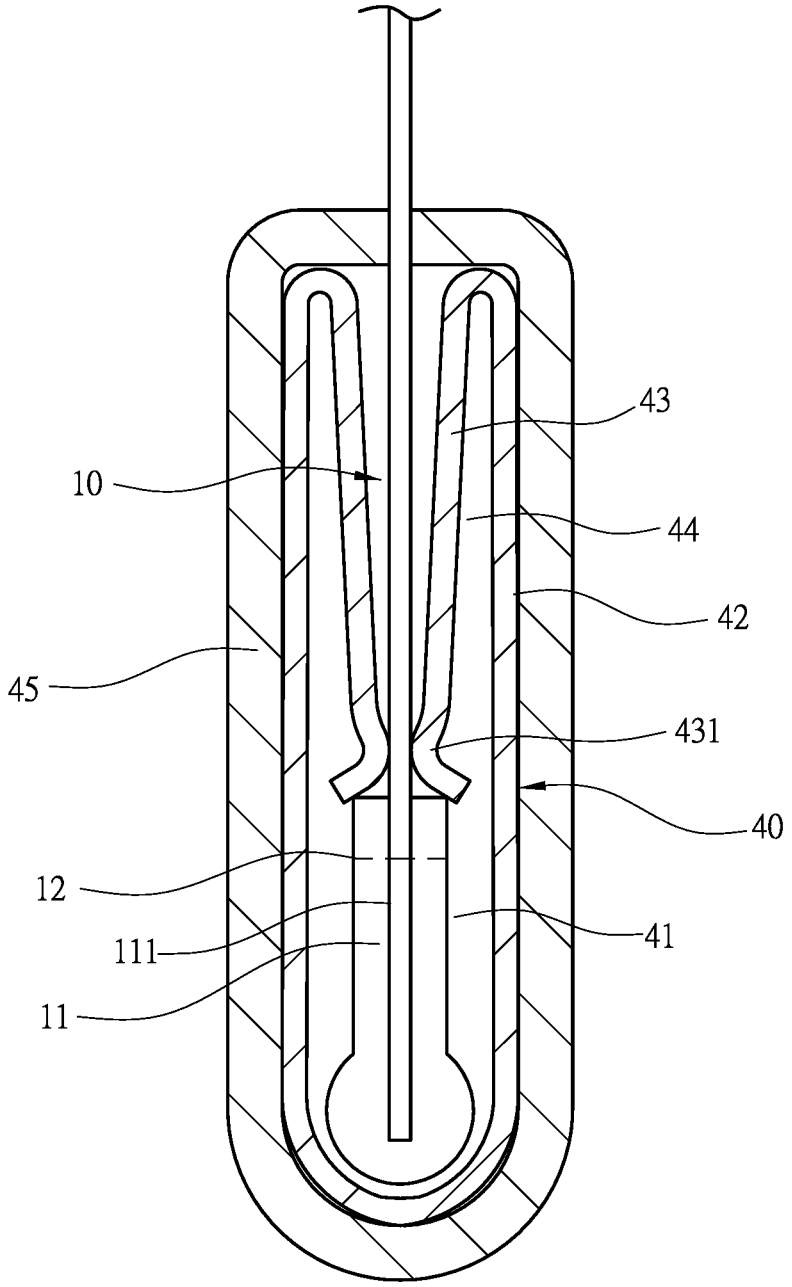
FIG. 7 is a sectional view illustrating the weight track is coupled with two covers in the present invention.

Structurally, referring to FIGS. 1 to 7, the shade (10) is inserted and secured with the sliding unit (20) through the mount bar (11) on the top portion of the shade (10), and is connected to the weight track (40) through the mount bar (11) on the bottom portion of the shade (10). The weight track (40) is sleeved on the mount bar (11), and the mount bar (11) is secured between the two locating boards (43) in the connecting space (41). The two covers (45) are respectively coupled on the two lateral ends of the weight track (40). The inner diameter of the cover (45) is smaller than the outer diameter of the weight track (40) and the buffering space (44) is formed between the locating board (43) and the abutting portion (42), so that the two locating boards (43) are respectively pushed inwardly through the buffering spaces (44), and the covers (45) are sleeved on the two lateral ends of the weight track (40). The outward stretching force of the weight track (40) and the inward force from the covers (45) pressing on the abutting portions (42) of the weight track (40) are adapted to support the positions of the covers (45) and the weight track (40) so as to securely connect the covers (45) with the weight track (40). In addition, the blocking portions (431) on the ends of the sloped locating boards (43) are adapted to abut against a top end of the mount bar (11) so as to secure the weight track (40) on the bottom portion of the shade (10).

Comparing with conventional window curtain, the present invention is advantageous because: (i) the mount bars (11) on the top portion and the bottom portion of the shade (10) are adapted to enable the shade (10) to horizontally install on the top track (31) of the window curtain (30) and also to enable the weight of the weight track (40) to be evenly distributed on the bottom portion of the shade (10), thereby smoothing the operation of the shade (10); (ii) each of the two lateral ends of the mount bar (11) comprises one inclined guiding edge (112), which enables the shade (10) to be installed easily; (iii) the mount bars (11) on the top portion and the bottom portion of the shade (10) can easily connect to the sliding unit (20) and the weight track (40) so that the consumers can easily install and replace different styles of shades (10) by themselves with low costs; (iv) the weight track (40) is made of iron, which is processed after been surface treatment, and the thickness and weight thereof can be customized according to the requirements so as to reduce structural cost and to ensure that the weight of the weight track (40) is sufficient to prevent the shade (10) from blown away by wind; (v) the weight track (40) is coupled outside of the mount bar (11) through the connecting space (41), and with the locating boards (43) and the buffering spaces (44), when the covers (45) are coupled on the two lateral ends of the weight track (40), the flexible abutting portions (42) are stretched inwardly to enable the covers (45) to sleeved thereon easily, and the abutting portions (42) are stretched outwardly after the covers (45) are sleeved on the weight track (40) so as to secure the positions of the covers (45); and (vi) the blocking portions (431) of the locating boards (43) are adapted to couple on the shade (10) to prevent the weight track (40) from detached from the shade (10), which enables the window shade to be used safely.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A window shade comprising a shade, and each of a top portion and a bottom portion thereof having a mount bar; each of the mount bars being an elongated board body having a U-shaped cross section, and a connecting groove formed inside the mount bar; each of the top portion and the bottom portion of the shade is inserted into the respective connecting groove of each of the mount bar, and the two mount bars respectively secured on the top portion and the bottom portion of the shade through two stitching lines; the shade is installed into a sliding unit through the mount bar on the top portion of the shade, and the mount bar, which is on the bottom portion of the shade, coupled with a weight track; the weight track formed into a U-shape, and a connecting space formed inside the weight track, and two abutting portions respectively formed at two lateral sides of the connecting space; each of two top ends of the two abutting portions bent inwardly to form a locating board, and each of the two locating boards sloped from top to bottom; each buffering space formed between each locating board and each abutting portion enable the abutting portion to slightly expand outwardly; an end of each locating board having a bent blocking portion; each of two lateral ends of the weight track coupled with a cover, and an inner diameter of the cover being smaller than an outer diameter of the weight track, wherein the mount bar at the bottom portion of the shade is received within the connecting space of the weight track and is retained within the weight track by the locating boards and buffering spaces when the abutting portions are stretched inwardly to enable each of the covers to be sleeved onto respective lateral ends of the weight track and the abutting portions are stretched outwardly after the covers are sleeved and secured in position on the weight track to thereby couple the weight track to the mount bar.

2. The window shade of claim 1, wherein each of two lateral ends of each of the mount bars has an inclined guiding edge.

3. The window shade of claim 1, wherein the weight track is made of iron.

* * * * *